United States Patent [19]

Jakubowski et al.

[11] 4,268,323

[45] May 19, 1981

[54] PROCESS FOR CASE HARDENING STEEL

[75] Inventors: Thomas M. Jakubowski, Salem, Oreg.; William G. Wood, Grosse Pointe Farms, Mich.

[73] Assignee: Kolene Corp., Detroit, Mich.

[21] Appl. No.: 165,002

[22] Filed: Jul. 1, 1980

Related U.S. Application Data

[63] Continuation-in-part of Ser. No. 27,306, Apr. 5, 1979, abandoned.

[51] Int. Cl.[3] ..... C21D 1/48

[52] U.S. Cl. ..... 148/15.5; 148/19; 148/20; 148/28; 148/30

[58] Field of Search ..... 148/15.5, 19, 20, 27, 148/28, 30

[56] References Cited

U.S. PATENT DOCUMENTS 2,049,806 8/1936 Holt ..... 148/15.5

2,541,085 2/1951 Morral ..... 148/30

3,303,063 2/1967 Pietryka ..... 148/20

3,912,547 10/1975 Gaucher et al. ..... 148/15.5

*Primary Examiner*—L. Dewayne Rutledge

*Assistant Examiner*—John P. Sheehan

*Attorney, Agent, or Firm*—William N. Hogg

[57] ABSTRACT

A process for case hardening steel is described. A fused bath of inert salt is maintained which bath is comprised of alkali or alkali earth halides, and alkali, or alkaline earth oxides or carbonates. To this fused bath is added urea, dicyanodiamide or pyrolysis/condensation products of urea or dicyanodiamide. This will form active ions containing carbon and/or nitrogen, and either the nitrogen and/or carbon will diffuse into the surface of a steel piece suspended in the bath to form either a nitride, carbonitride or carburized case depending upon the temperature of the bath, which is maintained between above 540° C. and about 950° C.

11 Claims, 1 Drawing Figure

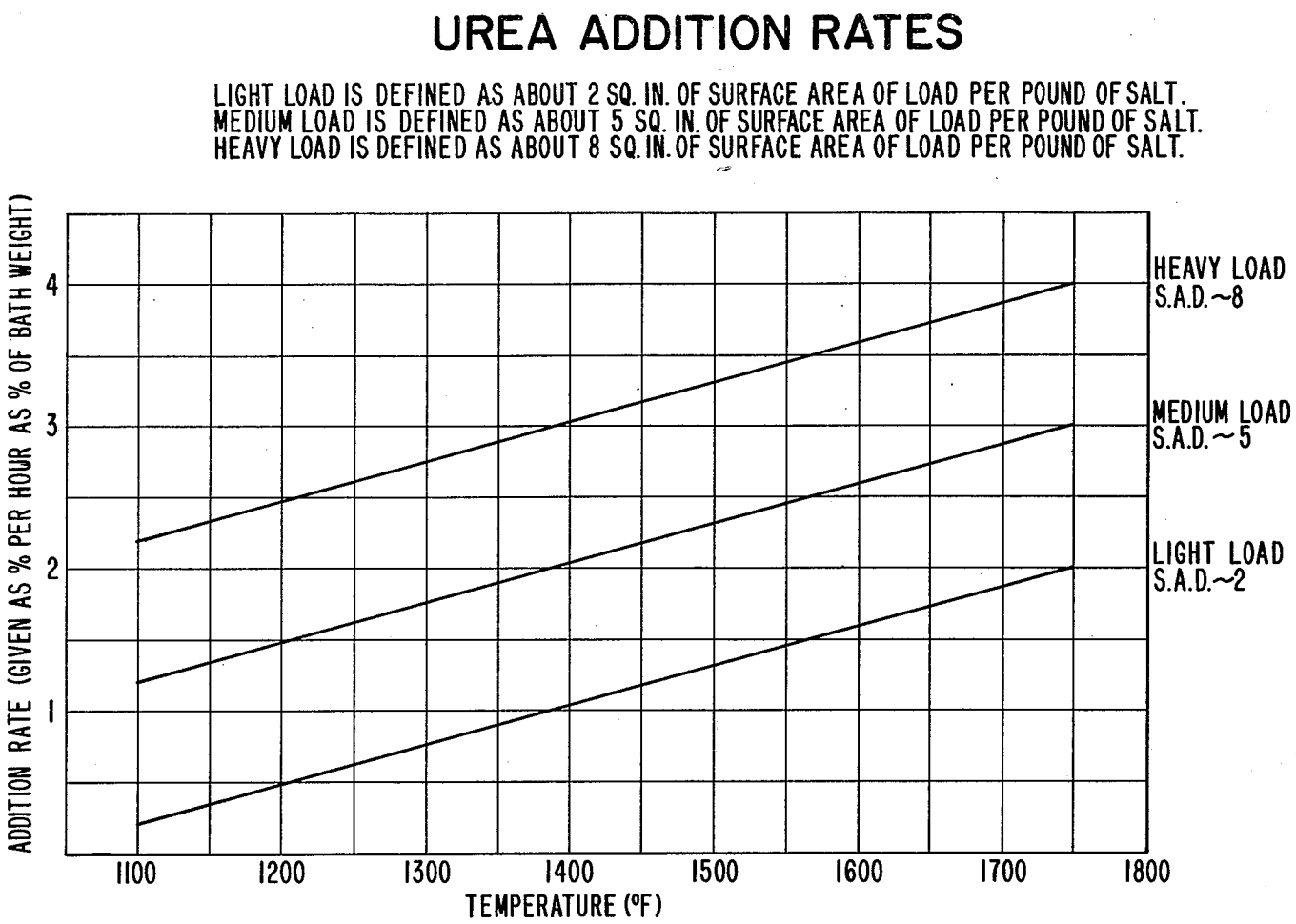
UREA ADDITION RATES
LIGHT LOAD IS DEFINED AS ABOUT 2 SQ. IN. OF SURFACE AREA OF LOAD PER POUND OF SALT.
MEDIUM LOAD IS DEFINED AS ABOUT 5 SQ. IN. OF SURFACE AREA OF LOAD PER POUND OF SALT.
HEAVY LOAD IS DEFINED AS ABOUT 8 SQ. IN. OF SURFACE AREA OF LOAD PER POUND OF SALT.
HEAVY LOAD S.A.D.~8
MEDIUM LOAD S.A.D.~5
LIGHT LOAD S.A.D.~2
ADDITION RATE (GIVEN AS % PER HOUR AS % OF BATH WEIGHT)
4
3
2
1
1100
1200
1300
1400
1500
1600
1700
1800
TEMPERATURE (°F)

PROCESS FOR CASE HARDENING STEEL

BACKGROUND OF THE INVENTION

This is a continuation-in-part of application Ser. No. 27,306, filed Apr. 5, 1979, entitled "Process for Case Hardening Steel".

There have been many prior art proposals for the nitriding, carbonitriding, and carburizing of steel parts. These have taken the form of cyanide salt baths, cyanide/cyanate salt baths, gas carburizing, and so forth. Up until now, each of these prior art processes has been performed independently of the others. For example, the nitriding process has operating conditions and parameters so different from those needed for carburizing that separate processing equipment and chemicals have to be maintained for each process. As a result, the operating conditions for each conventional process are rather inflexible; and can produce only a narrowly defined type of case.

Additionally, each of these types of processes has certain serious limitations. The cyanide or cyanide/cyanate processes require baths to be maintained with a relatively high concentration of active ingredients, which is both expensive and presents a toxic material waste problem. Gas carburizing and carbonitriding has problems in a high investment for equipment, high energy consumption, and a need for precise atmosphere control. Pack carburizing is very dirty, time consuming, and limited in scope.

Furthermore, none of these processes are designed to operate in the 600°–760° C. (1100°–1400° F.) temperature range. This range could hold great benefits for case hardening of steel parts in certain applications.

SUMMARY OF THE INVENTION

According to the present invention, a method and composition is provided in which either the nitriding, carbonitriding, or carburizing of steel parts may be accomplished; in which a non-active fused chemical salt bath is maintained, to which an organic material is decomposed in the bath forming active carbon and nitrogen containing ions as needed; and thereby allowing nitriding, carbonitriding, or carburizing to occur, depending upon the temperature of the bath. The invention includes the possibility of case formation in the previously neglected temperature range of 600°–760° C. (110°–1400° F.)

DESCRIPTION OF THE DRAWING

The single FIGURE is a graphical representation of the optimum rates of addition of urea to the fused bath as a function of temperature and size of the load being treated. The graph is intended as a rough guideline for most low carbon, low alloy steel treatment.

DESCRIPTION OF THE PREFERRED EMBODIMENT

According to the present invention, a method and composition are provided which allow one to selectively nitride, carbonitride, or carburize a steel work piece to provide the desired case thereon. The method employs a fused, non-active chemical salt bath to which is added an organic material which will form certain carbon and nitrogen compounds, said compounds having the ability to add carbon, nitrogen, or both to a steel surface immersed in the bath.

As used herein, non-active bath means a bath which itself neither generates nor contains "active" compounds. "Active" compounds upon giving up carbon and/or nitrogen to the steel to form a case thereon, are transformed into non-active compounds.

The characteristics of the case on the steel will depend primarily on the temperatures of the bath and the rate at which organic material is presented to the bath, so that either a nitrided, carbonitrided, or carburized case may selectively be obtained. A nitrided case is defined herein to mean a case comprised essentially of iron and nitrogen, usually in the form of iron nitrides. A carburized case is defined to mean a case comprised essentially of iron and carbon, and a carbonitrided case is defined as one which contains iron with significant amounts of both carbon and nitrogen.

The organic material usually is added only so long as there is work in the bath to be treated. After the treatment is finished, the addition of material may be ceased. Carbon and nitrogen containing compounds are no longer generated, and residual active compounds are slowly destroyed by thermal decomposition, or by reaction with the walls of a metallic salt pot if such type of pot is used. Hence, the bath when not in used becomes non-active; there is no need to maintain a high concentration of toxic materials such as cyanides and cyanates.

Turning now more specifically to compositions of the materials involved in this invention, the non-active chemical salt bath may be any fused alkali or alkaline earth halide, or combination of such halides, with from about 1 to about 20 weight percent added thereto of an alkali or alkaline earth oxide or carbonate, or mixtures of such carbonates and oxides. A preferable composition is from 64–68 weight percent calcium chloride, $CaCl_2$; 30–32 weight percent sodium chloride, $N_aCl$; and 1–5 weight percent calcium carbonate, $CaCO_3$. The melting point of this composition is about 510° C. (950° F.). The organic material for addition to the bath may be urea or dicyanodiamide. It may also be any of the pyrolysis/condensation products of urea or dicyanodiamide, such as melamine, melem, melam, and melon. It may also be any combination of the aforesaid organic materials. In operation, the non-active bath is first brought to the desired operating temperature, chosen from within the range of about 540° C. (1000° F.) to about 950° C. (1750° F.). The selection of the temperature will be discussed presently. The organic material is then added to the bath, preferably slowly, continuously, and at a constant rate. Somewhat complicated reactions now occur, which may be summarized as follows:

Organic material + Oxide ($O^{-2}$) and/or carbonate ($CO_3^{-2}$) → Cyanamide ($CN_2^{-2}$) + non active compounds The amount of cyanamide formed is limited by the initial concentration of oxide/carbonate. Thus, if the initial oxide/carbonate amount was 3 weight percent, the maximum amount of cyanamide that can form in the bath is also 3 weight percent. Excess organic material is thermally decomposed and is lost.

The work pieces to be treated may be immersed in the salt bath either before or after addition of organic material has begun. The pieces should be clean and dry. The pieces are maintained in the bath for virtually any amount of time, depending upon the case thickness required. The general reaction at a steel surface in the bath is as follows:

$$\text{cyanamide ions} \xrightarrow[\text{+ trace oxygen and/or carbon dioxide}]{\text{+ iron surface coordination/ decomposition}}$$

oxide ($O^{-2}$) and/or carbonate ($CO_3^{-2}$) ions+carbon (C) and/or nitrogen (N) for diffusion into steel.

Thus it can be seen that the non-active oxides and carbonates, consumed in the generation of active cyanamide ions, are regenerated when the cyanamide decomposes at the steel surface, and hence no waste product salts build up in the bath to interfere in the process.

Agitation of the bath during operation is desirable, in order that active compounds may be evenly dispersed to the entire load. Agitation is usually accomplished by means of either a stirring mechanism, or by bubbling a gas such as air or nitrogen through the bath.

Repeated analysis of the bath during the process of this invention while the organic material is being added has shown that no alkali and/or alkaline earth metal cyanide and/or alkail and/or alkaline earth metal cyanate salts and in fact no cyanides or cyanates are produced. Thus the bath is free of alkali and/or alkaline earth metal cyanide or alkali and/or alkaline earth metal cyanate salts, and in fact all cyanides and cyanates before the process, during the process, and after the process is completed. The optimum rates of addition for temperatures between 590° C. (1100° F.) and 950° C. (1750° F.) are shown in graphic form in the figure. As can be seen in the figure, the size of the load being treated has been divided somewhat arbitrarily into three categories; light loads (2 square inches of load surface area per lb. of salt); medium loads (5 sq. inches of surface area of load per lb. of salt); and heavy loads (8 sq. inches of surface area of load per lb. of salt). The rates of addition for each type of load are graphed as the addition rate in % per hour based on bath weight as a function of temperature and varies from about 0.2% to about 4%. Of course, different load surface areas can be extrapolated from those graphed. The addition is based on urea being added, but slight experimentation will determine the optimum rate for the other materials.

When the desired immersion time is up, the work pieces are withdrawn from the bath and then either slow cooled or quenched in an appropriate quenching medium, again depending upon the case characteristics desired. The addition of organic material, having been continued during the immersion of the pieces, may now be ceased. If desired, organic material addition may be terminated before the pieces are withdrawn, to allow the residual active compounds and the thermal diffusion effects to complete the case formation.

One great advantage inherent in this invention is the variety of possible case types, arising from the flexibility of operating conditions. The type of case formed on the steel is primarily dependent upon the temperature at which the bath is maintained, the type of quench applied, and the composition of the base steel. In general, for low carbon low alloy steels, the case formed at or below 590° C. (1100° F.) is essentially a nitride case, i.e., a case containing essentially iron and nitrogen. The outermost portion of the case usually consists of iron nitrides E FeN, E $Fe_3N$, and/or $\delta'Fe_4N$.

Below the nitrides, a zone of nitrogen dissolved in alpha iron usually exists. As the treatment temperature rises above 590° C. (1100° F.), the case will contain progressively more carbon and less nitrogen. Hence, the temperature range of about 590° C. (1100° F.) to about 815° C. (1500° F.) is termed the "carbonitriding" range. In general, within these operating temperatures the case is formed in conjunction with a fast quench, such as with water or oil. The case formed is primarily martensitic or bainitic, because addition of nitrogen to the iron at these temperatures has stabilized gamma iron, into which carbon may readily dissolve. Because the core material is still below its critical transformation temperature, the fast quench forms martensitic/bainitic structures only in the region of the case; the core material is essentially unaffected. If desired, a high organic material feed rate will produce a case type consisting of an outer layer of essentially iron nitride, under which exists an austenitic or pearlitic zone.

From operating temperatures of about 815° C. (1500° F.) to about 950° C. (1750° F.), the case consists of essentially iron and carbon; this is the "carburized" case. Again, this case is usually fast quenched to produce a martensitic or bainitic structure.

Of course, if there are different alloying elements present there will be somewhat more complex cases formed, but there will be essentially those general types described, modified by the alloying elements and the modifications of certain of the critical temperatures as is well known in the art.

Thus it will be seen that all of these different case types can be formed from a single fused salt bath and a single organic addition agent which generates active C and N compounds as needed. The cases are varied by merely changing the operating temperature, the quench conditions, or the organic feed rate.

What is claimed is:

1. A process for forming a hardened case on a ferrous metal comprising the steps of maintaining, at a temperature from about 540° C. (1000° F.) to about 950° C. (1750° ), a fused chemical salt bath consisting essentially of a first material selected from the group consisting of alkali halides, or alkaline earth halides, or mixtures thereof; and a second material selected from the group consisting of alkali oxides, alkaline earth oxides, alkali carbonates, alkaline earth carbonates, or mixtures thereof; said bath being maintained free of cyanide and cyanate salts, suspending the metal workpiece to be case hardened in said bath; thereafter adding to said bath a third material or combination of materials selected from the group consisting of urea, dicyanodiamide, and any of the pyrolysis/condensation products of urea or dicyanodiamide; or combinations thereof at a rate which will not produce cyanide or cyanate salts whereby to form in situ active case producing ingredients to thereby produce a case on said workpiece, removing said workpiece, and thereafter maintaining said bath free of cyanide and cyanate salts, with the original first and second material.

2. The invention as defined in claim 1 wherein the temperature of the bath is maintained between about 540° C. and about 590° C., whereby to form an essentially nitride case.

3. The invention as defined in claim 1 wherein the temperature of the bath is maintained between about 590° C. and about 815° C., whereby to form a carbonitride case.

4. The invention as defined in claim 1 wherein the temperature of the bath is maintained between about 815° C. and about 950° C., whereby to form an essentially carburized case.

5. The invention as defined in claim 1 wherein the first material is a mixture of $CaCl_2$ and NaCl, and wherein said second material is $CaCO_3$.

6. The invention as defined in claim 5 wherein said first material includes about 64–68 percent by weight $CaCl_2$, about 30–32 percent by weight NaCl, and wherein said second material includes about 1–5 percent by weight $CaCO_3$.

7. The invention as defined in claim 1 wherein the third material is urea.

8. The invention as defined in claim 1 wherein the third material is dicyanodiamide.

9. The invention as defined in claim 1 wherein the third material is a pyrolysis/condensation product of dicyanodiamide.

10. The invention as defined in claim 7 wherein the rate of addition of urea is from about 0.1 to about 4 percent by weight of the bath per hour of addition time.

11. The invention as defined in claim 7 wherein the rate of addition of urea is controlled as a function of temperature and load size as depicted in the graph of FIG. 1.

* * * * *